US005311967A

United States Patent [19]

Kennedy

[11] Patent Number: 5,311,967

[45] Date of Patent: May 17, 1994

[54] HAND CLIMBER

[76] Inventor: Mark B. Kennedy, 4670 Horn Rd., York, Pa. 17406

[21] Appl. No.: 56,862

[22] Filed: May 5, 1993

[51] Int. Cl.[5] ..... A63B 27/02

[52] U.S. Cl. ..... 182/133; 182/187

[58] Field of Search ..... 182/133-136, 182/187

[56] References Cited

U.S. PATENT DOCUMENTS

| | | | |
|---|---|---|---|
| 480,941 | 8/1892 | Stow | 182/187 X |
| 1,275,392 | 8/1918 | Collins | 182/187 |
| 3,817,350 | 6/1974 | Gray | 182/187 |
| 3,955,645 | 5/1976 | Dye | 182/135 |
| 4,168,765 | 9/1979 | Ferguson et al. | 182/135 |
| 4,595,076 | 6/1986 | Gober | 182/136 |
| 4,641,727 | 2/1987 | McKelvy | 182/187 |
| 4,809,815 | 3/1989 | Wallace | 182/133 |
| 4,830,143 | 5/1989 | Fisher | 182/187 X |
| 4,909,353 | 3/1990 | Govin et al. | 182/187 |

FOREIGN PATENT DOCUMENTS

| | | | |
|---|---|---|---|
| 809611 | 7/1951 | Fed. Rep. of Germany | 182/187 |

*Primary Examiner*—Alvin C. Chin-Shue
*Attorney, Agent, or Firm*—Charles J. Long

[57] ABSTRACT

A hand climber for use in climbing trees or similar vertical members includes a rigid cylindrical support bar and a flexible strap. One end of the strap is attached to the support bar at a fixed location on the strap and the other end of the strap is removably attachable to the support bar at any of a series of locations along the length of the strap. The strap is formed from extruded nylon 6 with yield tensile strength between about 10,000 and about 15,000 psi. An extruded rubber sleeve may optionally be slidably positioned on the strap for improved frictional contact with the vertical member being climbed. The hand climber may also optionally include a seat assembly hingedly mounted on the support bar.

7 Claims, 2 Drawing Sheets

HAND CLIMBER

BACKGROUND OF THE INVENTION

1. Field of the Invention

This invention relates to hand climbers for use when raising or lowering tree stands such as that shown in U.S. Pat. No. 3,955,645, and for other uses. More particularly, the invention relates to a lightweight readily-portable hand climber which avoids damage to the surface of the tree o other member being climbed, and which may optionally include a seat assembly which pivots out of the way when climbing.

2. Description of the Prior Art

Game hunters commonly use so-called climbing tree stands to position themselves above the ground on a tree trunk for better hunting and spotting their prey. Various designs of such tree stands are shown in the prior art; they are generally fabricated principally of metal and designed to be raised to a selected height on the trunk and anchored there, for example by spike-like members which dig into the trunk to prevent slippage. Some tree stands can only be raised by use of the hunter's hands, but most can also be lifted using the feet, provided the hunter has a means of hand support above the tree stand while so lifting the stand. Dye U.S. Pat. No. 3,955,645 shows one such foot-liftable tree stand.

As above indicated, in order to lift or lower a tree stand using the feet, the hunter must be able to hang by his or her hands from a supporting member. Tree limbs can act as such supporting members, but frequently such limbs are too high up the trunk for the hunter to reach. Accordingly, a number of prior art workers have developed so-called hand climbers to provide supporting hand grips for use with foot-liftable tree stands. Such prior art hand climbers have various deficiencies, as will now be discussed.

Ferguson et al. U.S. Pat. No. 4,168,765 provides a horizontal metal gripping bar and four rigid elongated metal links pivotally connected end to end with the distal ends of the first and fourth links slidably positioned on the bar. In use, edges of the links contact and dig into the trunk at four points around the circumference and thereby support the weight of the climber hanging on the bar. This arrangement, being of metal, is heavy and cumbersome to use and can cause damage to the tree trunk where the link edges engage the trunk.

Gober U.S. Pat. No. 4,595,076 provides a flexible metal strap one end of which is pivotally connected to a corner of a rectangular metal plate. At the diagonally opposite corner of the plate an extending pin is engaged by one of a series of longitudinally extending spaced holes formed in the body of the metal strap. A metal bar is fastened to the plate and oriented across the diagonally opposite corners not occupied by the strap ends. In use the strap is tightened around the tree trunk as much as possible by pulling the free end of the strap and then slipping the nearest strap hole over the engaging pin. The climber then grasps the end of the bar, which is initially at an angle with respect to the horizontal, and twists it toward the horizontal to thereby force the strap even more tightly against the trunk. Support of the climber is thus achieved partly by friction and partly by the edge of the strap digging into the tree trunk. Like Ferguson et al.'s climber, the Gober device is of metal and thus heavy, causes damage to the tree trunk, and is difficult to use safely since force must be maintained on the bar at all times to keep the plate twisting for maximum strap tightness.

It is noted that neither the Ferguson et al. nor the Gober climber would be safe for use on a pole surface other than a tree trunk, e.g. a smooth hard surface into which the metal strap could not dig for support.

Other hand climbers exist, but all of which I am aware have similar or more serious deficiencies to those mentioned above; some include metal straps or some other feature such as teeth for digging into, and thereby damaging, the tree trunk to prevent slipping, and in some the gripping bar projects outwardly from the trunk toward the user, making it both difficult to hold comfortably and a potential hazard to the user's head. Examples of other climbers are shown in Dye U.S. Pat. No. 3,955,645 and Wallace U.S. Pat. No. 4,809,815.

SUMMARY OF THE INVENTION

I have developed a hand climber in which use of particular material and a simple design of predetermined dimensions overcomes the disadvantages of hand climbers of the prior art. Hand climbers according to my invention are extremely lightweight, cause no damage to the surface of the tree trunk or other vertical member being climbed, and possess sufficient strength to safely support even heavy climbers. Additionally, my climber may include an optional seat assembly which pivots out of the way when climbing.

In accordance with the invention, I provide a hand climber for supporting a person climbing a tree trunk or similar substantially vertical generally cylindrical member, comprising a flexible strap having first and second ends and length greater than the circumference of the tree trunk or similar member, the strap being formed from extruded nylon with yield tensile strength between about 10,000 and about 15,000 psi; a rigid elongated support bar having first and second ends; first attachment means for attaching the first end of the strap to the support bar at a first attachment point inboard from the first end of the support bar by a distance sufficient to allow the person climbing to grip the portion of the support bar between the strap and the first end of the support bar; and second attachment means for removably attaching the strap to the support bar at a second attachment point inboard from the second end of the support bar by a distance sufficient to allow the person climbing to grip the portion of the support bar between the strap and the second end of the support bar, said second attachment means providing for attachment at any of a series of predetermined locations along the length of the strap beginning at the second end of the strap.

In one embodiment the first attachment means comprise a hole formed in the strap at the first end of the strap and receiving the support bar, and two collars attached to the bar, one on either side of the first end of the strap, whereby the strap is retained at the first attachment point.

In a preferred embodiment the second attachment means comprises a longitudinal series of holes formed in the strap beginning at the second end of the strap, said holes being adapted for receiving by the second end of the bar, at least one diametric transverse hole formed through the bar at the second attachment point inboard of the second end, and a cotter pin adapted to engage the diametric hole to thereby retain the strap at the second attachment point when said second end engages a selected one of the longitudinal series of holes formed in the strap.

In a further preferred embodiment, the strap has a width of about 1 to about 2 inches and a width to thickness ratio of between 10:1 and 15:1, the holes formed in the strap are substantially circular and centered on the longitudinal center line of the strap, the hole diameters are no greater than one-half the strap width and are uniform in the longitudinal series of holes, the center-to-center spacing of adjacent holes in the longitudinal series is at least one inch, the distance from either strap end to the center of the hole closest to that end is at least one-half the strap width, and the end portions of the bar are shaped and sized to be closely received in the respective holes each engages.

For improved slip resistance, the climber may include an extruded rubber sleeve having a length of between about 5% and about 25% of the strap length, the sleeve defining a longitudinally extending orifice shaped and sized to slidably receive the strap, the sleeve being mounted on the strap for slidable positioning at a selected location along the strap's length.

Optionally, my climber may include a seat assembly hingedly mounted on the support bar.

Preferably, the seat assembly comprises a board-like seat member having substantially planar top and bottom surfaces, width no greater than the distance between the strap attachment points on the support bar, and length of between one and two times its width; at least one bracket having proximal end attached to the support bar by means allowing the bracket to rotate around the axis of the support bar and a distal end attached to the bottom surface of the seat member; and an elongated brace having a proximal end hingedly attached to the bottom surface of the seat member by means which permit the brace to move from a storage position adjacent the seat member to a use position in which the longitudinal axis of the brace forms a predetermined angle with the surface of the seat member, the brace length and predetermined angle being such that when the distal end of the brace contacts the surface of the tree trunk or similar member with the support bar axis in a horizontal position, the seat member top surface is in a generally horizontal plane.

For greater adaptability the length of the brace is adjustable.

Other details, objects and advantages of the invention will become apparent as the following description of a certain present preferred embodiment thereof proceeds.

BRIEF DESCRIPTION OF THE DRAWINGS

In the accompanying drawings I have shown a certain present preferred embodiment of the invention in which.

DESCRIPTION OF THE PREFERRED EMBODIMENT

Figure 1:
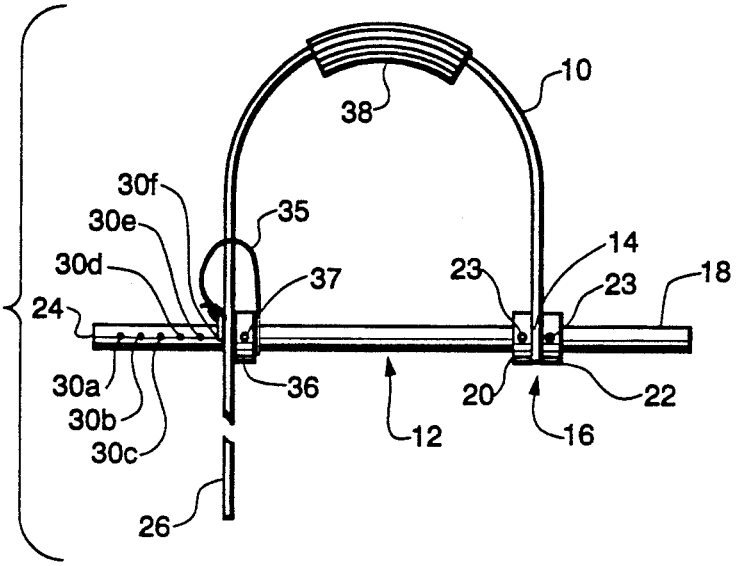
FIG. 1 is a top plan view of a hand climber according to the invention.

Although it will be appreciated that my invention is suitable for use on both tree trunks and other similar vertical members, for convenience the following description is restricted to tree trunks.

The key component of a climber according to the invention is a flexible strap 10 which attaches to a rigid elongated support bar 12. Whereas climbers of the prior art utilize steel or other metal for their straps or equivalent trunk-encircling members, and have occasionally used leather, I have discovered that a far superior material for the strap 10 is extruded nylon 6 processed to have a yield tensile strength of between about 10,000 and 15,000 psi. This material, the suitability of which has not been suggested by any prior art or by its suppliers to the best of my knowledge, is lightweight, strong, flexible over the widest range of temperatures in which such climbers are used, unaffected by prolonged outdoor exposure, not subject to stretching with prolonged use, and nondamaging to the tree trunk.

To function properly, strap 10 must be longer than the circumference of the tree trunk being climbed. I have found that a length of about 54 inches is suitable for most trees encountered by hunters and the like. The width and thickness of the strap determine its weight capacity, as will be appreciated. I have found that a width of about 1 to about 2 inches and a width-to-thickness ratio of between 10:1 and 15:1 provide a strap with more than adequate strength for use by a single person; typically, strap 10 is 1½ inches wide and ⅛ inch thick, i.e. with a width-to-thickness ratio of 12:1.

The rigid support bar 12 may take any of a number of suitable shapes and sizes; I prefer to use a cylindrical support bar fabricated from 6061 aluminum alloy, and typically use a bar having a diameter of ⅝ inch and length of 16 inches with straps of the preferred dimensions set forth above.

Means are provided for attaching a first end 14 of strap 10 to support bar 12 at a first attachment point 16 inboard of a first end 18 of the bar by a distance sufficient to permit gripping the portion of the bar between the first attachment point 16 and the end 18. In the embodiment shown, such means comprise a circular hole (not visible) formed in the strap at its end 14 through which the bar is passed until the strap is at the first attachment point 16. The hole is of essentially the same diameter as the bar, and for optimum force distribution and safety is preferably centered on the longitudinal centerline of the strap at a distance from first strap end 14 of at least one-half the strap width. The fastening means further comprise two collars 20 and 22, suitably also made from 6061 aluminum alloy, affixed by set screws 23 to bar 12 on either side of the strap, whereby the strap is retained at the first attachment point 16.

Figure 6:
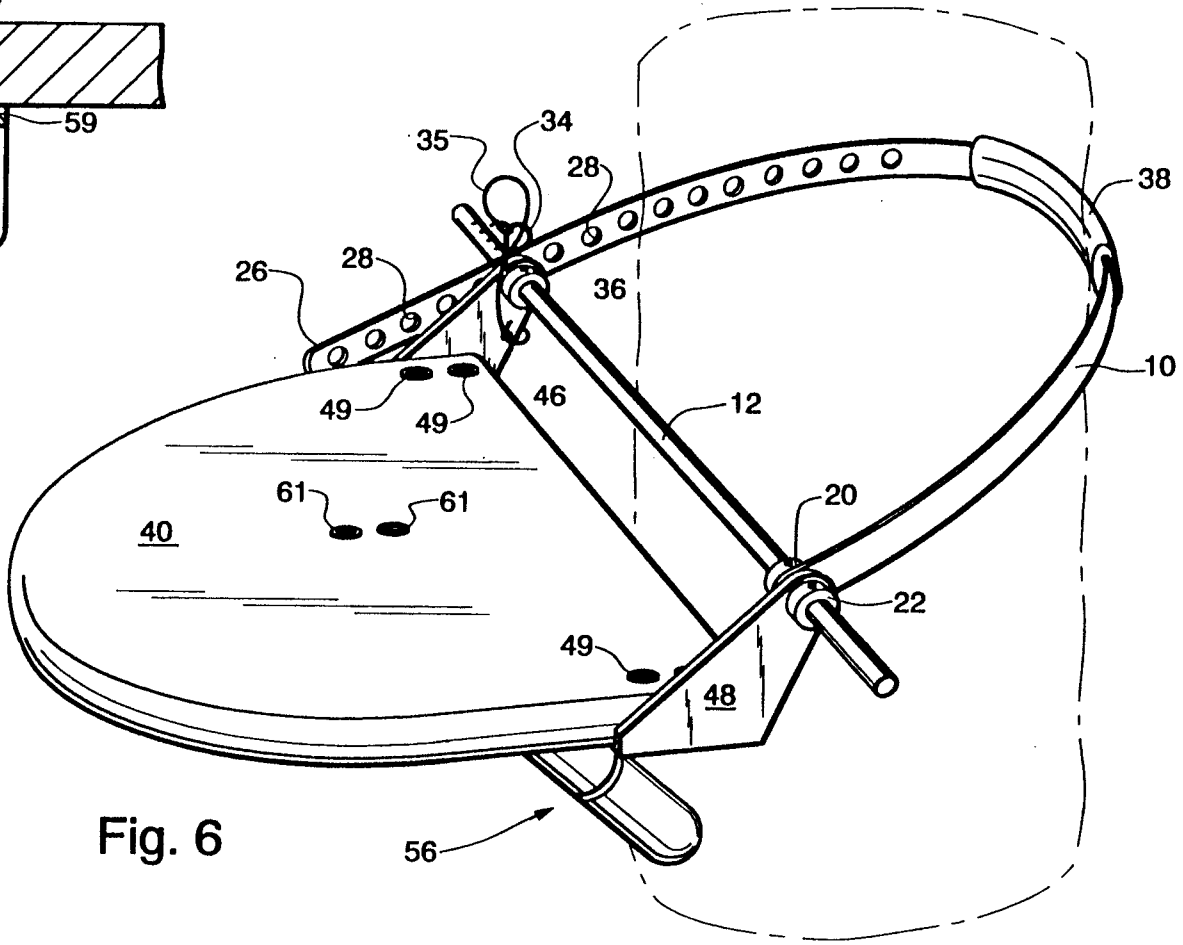
FIG. 6 is a perspective view of the climber of FIGS. 1 and 2 in place on a tree trunk, and including the seat assembly of FIGS. 3 through 5.

Means are also provided for removably attaching strap 10 to support bar 12 at a second attachment point inboard from the second end 24 of the bar, and allowing for attachment at any of a series of locations along the strap 10 beginning at the second end 26 of the strap, so as to permit use of the hand climber with tree trunks of various diameters. These means comprise a series of circular holes 28 of uniform diameter formed in the strap beginning at the second strap end 26; for optimum force distribution and safety the holes 28 are all centered on the longitudinal centerline of the strap, the center-to-center spacing of adjacent holes is at least one inch, and the center of the hole nearest strap end 26 is spaced from that end by at least one-half the strap width. In the embodiment shown, the diameter of each hole 28 is essentially equal to that of support bar 12 so that the support bar ca be received in a selected hole. A series of diametric holes 30*a* through 30*f* drilled through support bar 12 define a series of second strap attachment points on the bar adjacent to and inboard of each diametric hole, and a cotter pin 34 inserted in a selected one of holes 30*a* through 30*f* retains the strap on the bar at the corresponding second attachment point. A cord 35 retains cotter pin 34 on the bar when not in use. FIGS. 1 and 6 show a collar 36 attached by a set screw 37 to support bar 12 on the inboard side of the innermost second attachment point; this collar is optional in the basic hand climber, but is used when the optional seat assembly, discussed below, is used.

Figure 2:
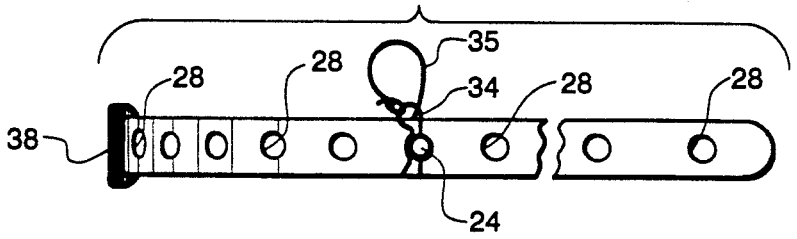
FIG. 2 is a side view of the climber of FIG. 1.
Figure 3:
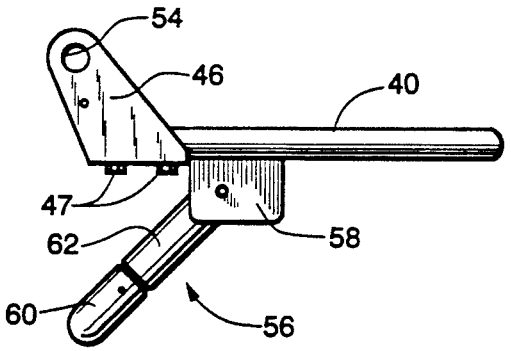
FIG. 3 is a side view of an optional seat assembly for use with the climber of FIGS. 1 and 2.
Figure 4:
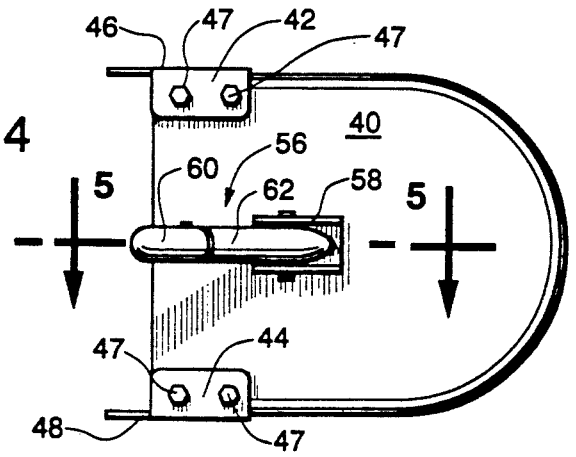
FIG. 4 is a bottom plan view of the seat assembly of FIG. 3.

To increase friction forces between my hand climber and the tree trunk, the climber preferably includes an extruded rubber sleeve 38 which defines a longitudinally extending orifice shaped and sized to slidably receive the strap 10. The length of the sleeve is preferably between about 5% and about 25% of the strap length, and for most straps I have found 4 inches to be a convenient sleeve length. A suitable material for the sleeve is EPDM rubber, compound No. 80K-307, having Durometer hardness of 80 and available from Western American Rubber Company of Orange, Calif. The overall cross sectional shape of one sleeve which I use is generally half-oval, having a substantially flat surface on the side away from the tree trunk and an arced surface on the trunk contacting side; this shape is apparent in sleeve 38 of FIGS. 1, 2 and 6. In use, sleeve 38 is preferably positioned on the strap such that it contacts the tree trunk on the side opposite support bar 12. Although not shown, I may also use a sleeve of similar material around the central portion of support bar 12 to both provide some additional friction forces between the bar and the tree trunk and prevent any damage to the trunk from the bar.

Referring now to FIGS. 3 through 6, my climber may optionally include a seat assembly as shown. The assembly comprises a board-like seat member 40, typically made of wood such as oak, having a generally U-shaped peripheral contour with a rounded front edge and a straight rear edge. Preferably seat member 40 has planar top and bottom surfaces, width no greater than the distance between the first and innermost second strap attachment points, and length between one and two times its width. Attached to the bottom surface of seat member 40 on either side of its rear portion are the distal ends 42 and 44 of two generally L-shaped brackets 46 and 48 formed from metal such as an aluminum alloy. Attachment of the distal ends is by bolts 47 tightened in threaded flanged liners 49. At their proximal ends the brackets are drilled to form circular holes, of which only hole 54 in bracket 46 is shown. The holes are sized to closely receive support bar 12 for pivotal movement therearound. The seat member width and spacing of brackets 46 and 48 are preferably such that when mounted on the support bar bracket 48 will be adjacent the first strap attachment point 16 and bracket 46 will be adjacent the innermost second strap attachment point, whereby bracket 48 can be held in place between the collars 20 and 22 which also hold strap end 14 in place, and bracket 46 can be positionally stabilized on its inboard side by collar 36.

Figure 5:
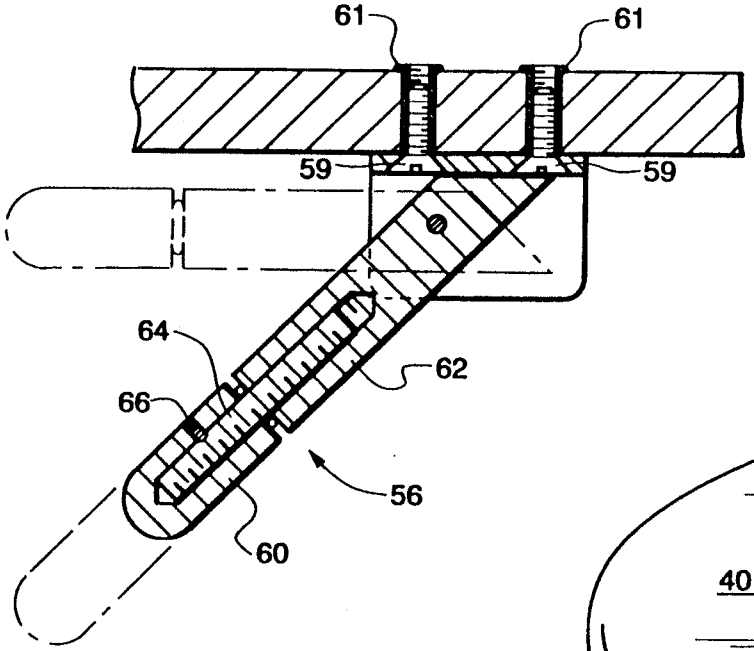
FIG. 5 is a view taken on line 6—6 of FIG. 4 showing the structure of a length-extendable brace for the seat assembly.

A longitudinally extendable brace 56 is hingedly mounted at its proximal end to a U-shaped bracket 58 attached by screws 59 in threaded flanged liners 61 to the center of the bottom surface of seat member 40, with the distal end of brace 56 extending in the direction of the rear of the seat, i.e. toward the tree trunk. As shown in FIG. 5, brace 56 can be moved from a storage position adjacent the seat member, shown in broken lines, to a use position in which it is angled downwardly from the seat member, viewing FIG. 5; the proximal end of the brace is cut at an angle, typically 45°, and mounted such that motion of the brace away from the seat member is stopped by the proximal end of the brace impinging on the upper surface of bracket 58, viewing FIG. 5. The angle of the brace's longitudinal axis at impingement, i.e. at the use position, is selected such that when the climber is mounted on a tree trunk with the axis of support bar 12 horizontal, the length of brace 56 can be adjusted so that when its distal end is against the tree trunk seat member 40 is in a substantially horizontal position, as generally shown in FIG. 6.

In order to provide length adjustability, brace 56 is fabricated in two sections 60 and 62. One end of a threaded member 64 is received in a bore in section 60 and held in place by a set screw 66; the other end, which extends from section 60, is received in a threaded bore in section 62. To adjust the length between the minimum, shown in solid lines in FIG. 6, and the maximum, shown in broken lines, section 60 is turned to screw or unscrew threaded member 64 into or out of the bore in section 62, as applicable.

In assembling the climber shown in FIG. 6, end 18 of support bar 12 is inserted first through hole 54 in bracket 46, then through collar 36, collar 20, strap end 14, the hole in the proximal end of bracket 48, and finally through collar 22. Strap end 14 is then located at the first attachment point 16 and the set screws in collars 20 and 22 are tightened to hold the strap end and bracket 48 in place, after which collar 36 is positioned next to bracket 46 and its set screw is tightened. The climber is now ready for use.

To use the climber of FIG. 6, support bar 12 is first held against the tree trunk; strap 10 is then passed around the trunk and the appropriate hole 28 is slipped over end 24 of the support bar and moved to a selected second attachment point after which cotter pin 34 is inserted in the adjacent one of holes 30*a* through 30*f* on the outboard side of the strap. Selection of the appropriate strap hole 28 is made by pulling strap 10 tightly around the trunk and determining which of holes 28 is the one farthest from strap end 26 that can be slipped over end 24 of the support bar. For climbing, the seat assembly is rotated so that seat member 40 is generally parallel to the tree trunk and brace 56 is moved to its storage position. When use of the seat assembly is desired, seat member is rotated down to a generally horizontal position, brace 56 is moved to the use position and the length of brace 56 is adjusted so the brace's distal end contacts the tree trunk, as shown in FIG. 6.

Although the foregoing describes a preferred hand climber according to the invention many variations will occur to others skilled in the art. Accordingly, while I have shown and described a certain present preferred embodiment of the invention, it is to be distinctly understood that the invention is not limited thereto, but may be otherwise variously embodied within the scope of the following claims.

I claim:

1. A hand climber for supporting a person climbing a tree trunk or similar substantially vertical generally cylindrical member, comprising:

a. a flexible strap having first and second ends and length greater than the circumference of the tree trunk or similar member, the strap being formed from extruded nylon 6 with yield tensile strength between about 10,000 and about 15,000 psi;

b. a rigid elongated cylindrical support bar having first and second ends;

c. first attachment means for attaching the first end of the strap to the support bar at a first attachment point on the support bar inboard from the first end of the support bar by a distance sufficient to allow the person climbing to grip the portion of the support bar between the strap and the first end of the support bar, said first attachment means comprising a hole formed in the strap at the first end of the strap and receiving the support bar, and two collars attached to the support bar, one on either side of the first end of the strap, whereby the strap is retained at the first attachment point; and d. second attachment means for removably attaching the strap to the support bar at a second attachment point on the support bar inboard from the second end of the support bar by a distance sufficient to allow the person climbing to grip the portion of the support bar between the strap and the second end of the support bar, said second attachment means providing for attachment at any of a series of predetermined locations along the length of the strap beginning at the second end of the strap, said second attachment means comprising a longitudinal series of holes formed in the strap beginning at the second end of the strap, said holes being adapted for receiving the second end of the support bar, and removable retention means for retaining the strap at the second attachment point when the second end of the support bar engages a selected one of the longitudinal series of holes formed in the strap.

2. A hand climber as claimed in claim 1 in which the removable retention means comprises at least one diametric transverse hole formed through the support bar at the second attachment point and a cotter pin adapted to engage the diametric hole.

3. A hand climber as claimed in claim 2 in which the strap has a width of about 1 to about 2 inches and a width to thickness ratio of between 10:1 and 15:1, the holes formed in the strap are substantially circular and centered on the longitudinal center line of the strap, the hole diameter are no greater than ½ the strap width and are uniform in the longitudinal series of holes, the center-to-center spacing of adjacent holes in the longitudinal series is at least one inch, the distance from either strap end to the center of the hole closest to that end is at least one-half the strap width, and the end portions of the bar are shaped and sized to be closely received in the respective holes each engages.

4. A hand climber as claimed in any of claims 1, 3 or 2, further including an extruded rubber sleeve having a length of between about 5% and about 25% of the strap length, the sleeve defining a longitudinally extending orifice shaped and sized to slidably receive the strap, the sleeve being mounted on the strap for slidable positioning at a selected location along the strap's length.

5. A hand climber as claimed in claim 4 including a seat assembly hingedly mounted on the support bar.

6. A hand climber as claimed in claim 5 in which the seat assembly comprises:

a. a board-like seat member having substantially planar top and bottom surfaces, width no greater than the distance between the strap attachment points on the support bar, and length of between one and two times its width;

b. at least one bracket having a proximal end attached to the support bar by means allowing the bracket to rotate around the axis of the support bar and a distal end attached to the bottom surface of the seat member; and c. an elongated brace having a proximal end hingedly attached to the bottom surface of the seat member by means which permit the brace to move from a storage position adjacent the seat member to a use position in which the longitudinal axis of the brace forms a predetermined angle with the surface of the seat member, the brace length and predetermined angle being such that when the distal end of the brace contacts the surface of the tree trunk or similar member with the support bar axis in a horizontal position, the seat member top surface is in a generally horizontal plane.

7. A hand climber as claimed in claim 6 in which the length of the brace is adjustable.

* * * * *